United States Patent [19]

Preuss et al.

[11] 4,368,444

[45] Jan. 11, 1983

[54] LOW-VOLTAGE PROTECTIVE CIRCUIT BREAKER WITH LOCKING LEVER

[75] Inventors: Bernhard Preuss; Werner Koziolek, both of Berlin, Fed. Rep. of Germany

[73] Assignee: Siemens Aktiengesellschaft, Munich, Fed. Rep. of Germany

[21] Appl. No.: 297,568

[22] Filed: Aug. 31, 1981

[30] Foreign Application Priority Data

Aug. 29, 1980 [DE] Fed. Rep. of Germany ... 8023509[U]

[51] Int. Cl.[3] ..... H01H 9/20

[52] U.S. Cl. ..... 335/166; 200/153 G; 200/DIG. 42; 335/169

[58] Field of Search ..... 335/166, 169; 200/153 G, 67 PK, DIG. 42

[56] References Cited

U.S. PATENT DOCUMENTS

| | | | |
|---|---|---|---|
| 3,605,052 | 9/1971 | Dimond et al. | 335/166 |
| 4,129,762 | 12/1978 | Bruchet | 335/166 |
| 4,165,453 | 8/1979 | Hennemann | 335/166 |

*Primary Examiner*—Harold Broome
*Attorney, Agent, or Firm*—Kenyon & Kenyon

[57] ABSTRACT

In the low-voltage circuit breaker that has a toggle lever system connecting the actuating arm to a carrier that moves the movable contact, a locking lever is provided to prevent transfer of the operating lever handle to its "off" position if the movable contact is welded to the stationary contact. The locking lever is pivoted about a bearing support formed in the housing of the circuit breaker. The opposite end of the locking lever is connected to the handle to be pivoted by it. The locking lever has an angled-off projection that extends into the path of movement of the carrier and is positioned to engage the carrier if the latter is unable to move from its "on" position due to welding of the contacts together. When the contacts are not welded together, the locking lever enforces the toggle levers to snap through to their "off" position before the angled-off part of the locking lever comes into contact with the carrier of the movable contact.

5 Claims, 3 Drawing Figures

LOW-VOLTAGE PROTECTIVE CIRCUIT BREAKER WITH LOCKING LEVER

BACKGROUND OF THE INVENTION

1. Field of the Invention

This invention relates to a low-voltage circuit breaker that has a carrier mounted on a control shaft and connected to a movable contact by means of a contact pressure spring and further provided with a toggle lever system connecting the operating handle and the carrier to separate the movable contact from the fixed contact in response to actuation of the operating handle. In particular, the invention relates to such a circuit breaker including a locking lever pivotably mounted in the housing of the circuit breaker and engaging the handle to be moved thereby and provided with means to engage the carrier when the handle is moved toward the "off" position if the carrier is locked on its "on" position by welding of the fixed and movable contacts together.

2. Prior Art

A circuit breaker generally similar to the present invention is shown in U.S. Pat. No. 4,165,453, in which a locking lever of a two-arm design is pivoted about a bearing formed by the toggle joint pin of a toggle lever system connected to the movable contact part of the circuit breaker. One of the lever arms of the locking lever is inside the turns of a drive spring that would normally separate the movable contact from the fixed contact when the actuating arm of the circuit breaker was moved to its "off" position. The other lever arm of the toggle system rests against the movable contact part of the circuit and, specifically, against the joint pin that establishes the connection of the toggle lever system with the movable contact portion. If the movable contact is blocked in the "on" position, for example, because of having the contact overlays of the stationary and movable contacts welded together, a force is exerted when an attempt is made to move the operating handle of the circuit breaker in the direction of its "off" position. This force is transmitted by the locking lever onto the toggle joint pin of the toggle lever system, which causes the latter to buckle in the direction of the "off" motion. However, the operating handle cannot be moved completely into its "off" position unless the force exerted on the toggle lever system is sufficiently large to break the contact weld.

OBJECTS AND SUMMARY OF THE INVENTION

A principal object of the invention is to provide a locking lever arrangement for a circuit breaker of the type mentioned which is simple to assemble and can, therefore, be used by manufacturers in those cases in which it is important to supply circuit breakers that can be made either with or without a locking lever arrangement.

Further objects will be apparent from the following specification together with the drawings.

According to this invention, a locking lever is supported in a bearing formed in the housing of a circuit breaker, and one end of the lever farthest from the bearing is connected to the operating handle of the circuit breaker. The locking lever is provided with a working surface which, in the undisturbed "on" position of the lever, is disposed opposite a counter surface of the movable contact structure of the circuit and at a distance therefrom corresponding to a small motion of the operating handle in the direction of its "on" position. The locking lever is also provided with a working surface opposite the toggle joint pin of the toggle lever system to actuate that system when the handle is moved toward the "off" position.

The structure is arranged so that it is not necessary to insert any part of the locking lever into the drive spring of the circuit breaker. On the contrary, it is sufficient that the drive lever and the locking lever engage each other by way of suitable surfaces.

It is a further advantage of the invention that the operator of the circuit breaker is able to perceive a distinct limitation of the extent of movement of the operating handle if the contacts are welded together and that this limitation of movement is more easily perceived than if the locking lever were connected to the drive spring.

The support point, or fulcrum, of the locking lever can be arranged as a recess in the circuit breaker housing and can be located between the control shaft and the stationary contact, preferably below a straight line connecting those parts. This permits the support point to be molded during the manufacture of the housing of the circuit breaker and without any additional parts being required. At the same time, the chosen arrangement of the support point is advantageous for the transmission of force to the movable contact portion. The locking lever according to the invention is also suitable for exerting a separation force at the location where the stationary and movable contact overlays are welded together.

The locking lever can be formed as a substantially flat sheet metal part, one end of which engages its support point in the housing and the opposite end of which engages the operating handle. The portions of the locking lever that engage the support point and the handle preferably have circular contours. A working surface that cooperates with the movable contact portion has an extension angled-off at its end. Making the locking lever of sheet metal permits it to be formed by simple stamping operations.

DETAILED DESCRIPTION OF THE INVENTION

Figure 1:
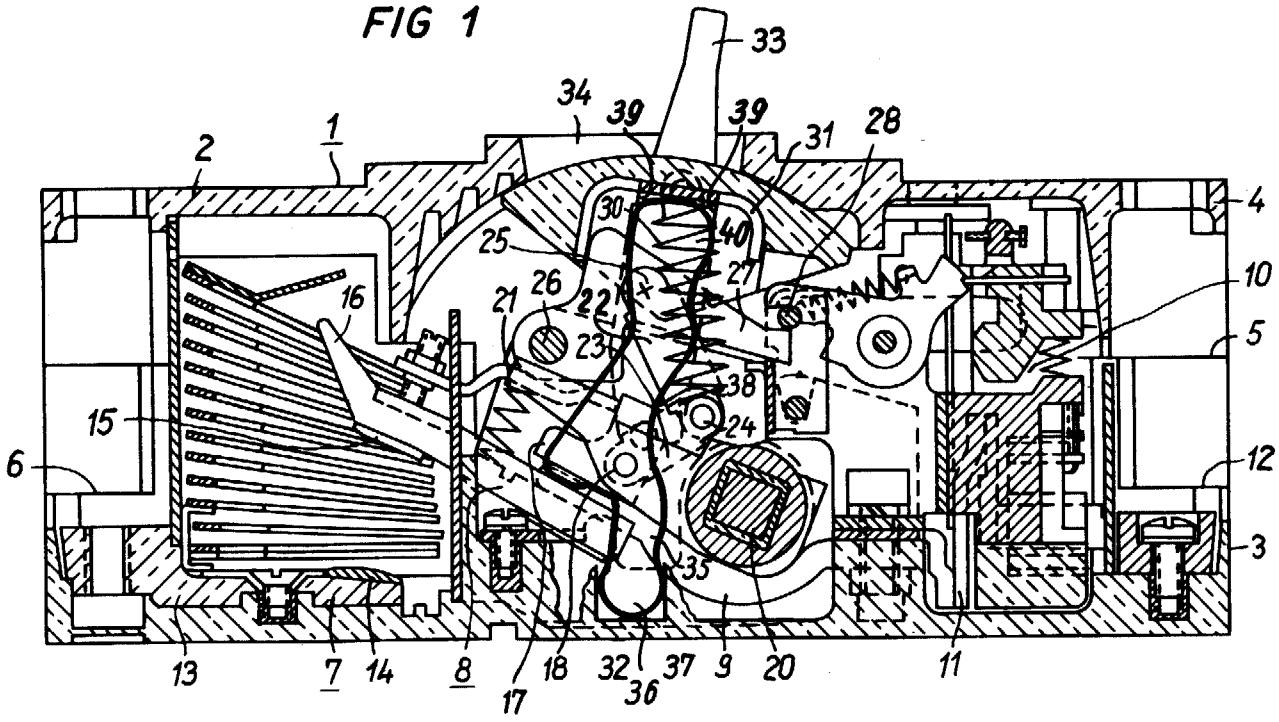
FIG. 1 is a cross-sectional, side-elevational view of a circuit breaker according to the present invention.

The low voltage protective circuit breaker 1 shown in FIG. 1 is of the type known as a compact breaker. It has a housing 2 of insulating material that has a lower part 3 (as positioned in FIG. 1) and an upper part 4 connected to each other along a parting line 5 so as to fit tightly together. The path of electrical current through the protective circuit breaker 1 extends from a first terminal 6 through a stationary contact 7, a movable contact 8, a flexible, conductive ribbon 9, a tripping device 10 through which a conductor 11 extends, and another terminal 12. The stationary contact 7 comprises a conductive section 13 fastened to the lower part 3 of the housing 2 and a contact overlay 14. This latter engages a similar contact overlay 15 of the movable contact 8 to establish a conductive path between the contact 7 and 8.

The movable contact further includes an arm 16 and a carrier 17 fastened to a control shaft 20 to be rotatably supported thereby in the housing 2. Between the arm 16 and the carrier 17 is a contact pressure spring 21 which is arranged to provide the required contact pressure between the overlays 14 and 15 when the circuit breaker 1 is in its "on" condition. A coupling is provided between the carrier 17 and the arm 16 in such a manner that the arm is automatically moved by the carrier after the latter has traveled a certain distance from the "on" position. A toggle lever system consisting of a pair of levers 22 and 23 engages the carrier 17 by means of a joint pin 18. The levers 22 and 23 are connected to each other by a toggle joint pin 24, and the lever 22 is connected by a pin 25 to a main pawl 27 pivotally mounted on a bearing 26. The toggle joint pin 24 is also engaged by a drive spring 30, the other end of which is connected to the upper end of an actuating lever 31 pivotally mounted on a stationary rotary bearing 32. The actuating lever 31 can be pivoted by hand by means of a handle 33 placed on the actuating lever 31 and protruding through an opening 34 in the upper part 4 of the housing 2.

In the locked condition of the circuit breaker 1, the main pawl 27 is braced against a latch bolt 28, in a manner such as is shown in detail in German Pat. No. 28 17 667. The latching arrangement is described in greater detail in that patent and, therefore, need not be described in detail here.

Figure 2:
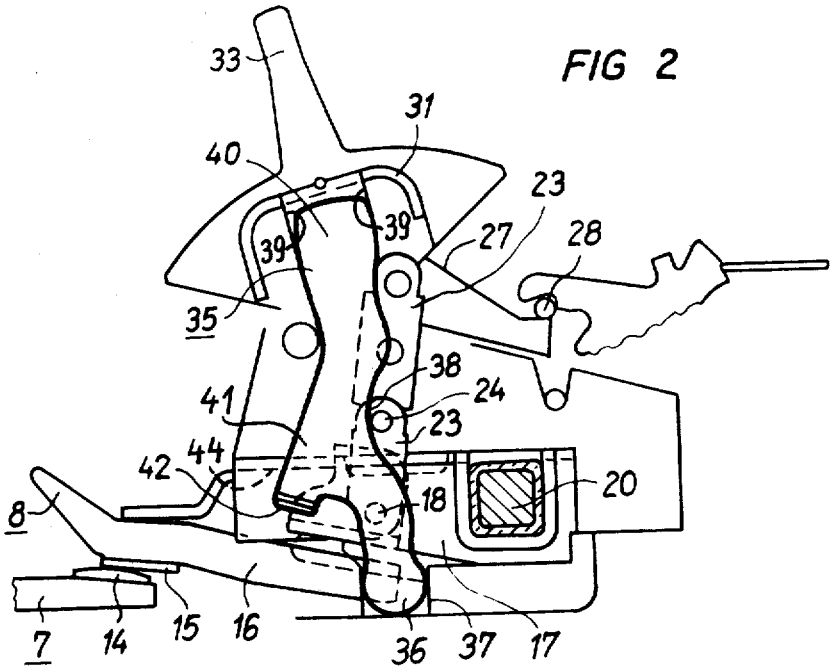
FIGS. 2 and 3 are simplified side-elevational views of part of the structure in FIG. 1 in different operating positions.
Figure 3:
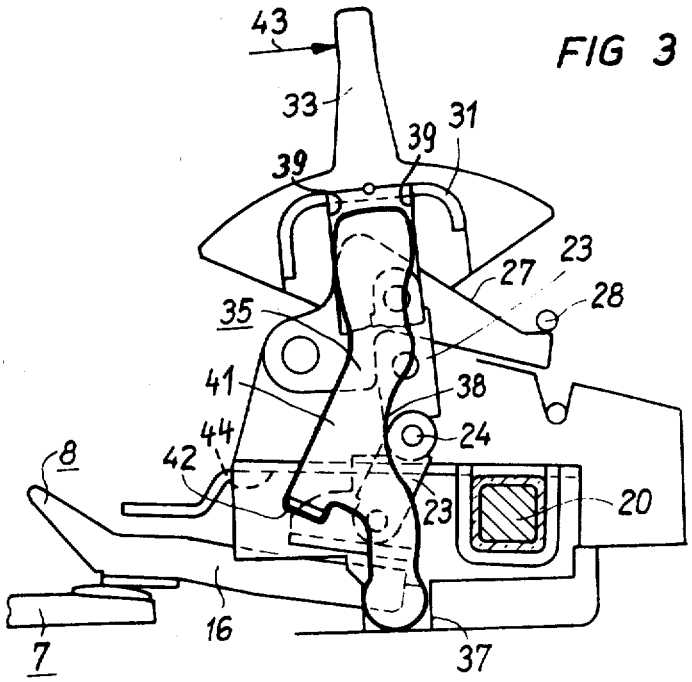

As is further shown in FIG. 1, the drive mechanism of the circuit breaker 1 contains a locking lever 35, which is also shown in FIGS. 2 and 3 with a heavier line width to make it more easily visible. The locking lever 35 has a circularly rounded lower end 36 that engages a recess 37 at the bottom of the lower part 3 of the housing 2. The opposite end 40 of the locking lever 35 also has surfaces that are rounded and cooperate with straight abutting surfaces 39 of the handle 33. In the middle region of the locking lever 35 is a working surface 38 in the form of a reces which, in the "on" condition, is spaced a short distance away from the toggle joint pin 24 of the toggle levers 22 and 23. The locking lever 35 also has an extension 41 with an angled-off end 42 that also forms a working surface. This surface cooperates with another abutting surface of the carrier 17 of the movable arm 16.

The "on" position of some of the parts is shown in FIG. 2. The handle 33 is near the left hand end of its range of travel. This position corresponds to the left end of the recess in the upper portion 4 of the housing 2, as shown in FIG. 1. The toggle levers 22 and 23 are resiliently biased by the drive spring 30 into a position slightly beyond dead center in such a way that the movable contacts are in the "on" position in which the overlays 14 and 15 firmly engage each other under the force provided by the contact pressure spring 21. The angled-off end 42 of the locking lever 35 is located opposite the abutting surface 44 of the carrier 17 and is spaced a small distance therefrom.

In switching the circuit breaker 1 to its "off" position by moving the operating handle 33 in the direction of the arrow 43, as shown in FIG. 3, the locking lever 35 is carried along in the same direction until the surface 38 of the locking lever hits the toggle joint pin 24. The levers 22 and 23 are forced to snap through their metastable position into their "off" position. Normally, the switching-off of current through the circuit breaker 1 follows as the movable contact 8 is pivoted clockwise by the control shaft 20 until it reaches the position shown in FIG. 1. However, if the contact overlays 14 and 15 are welded together, the parts occupy the positions shown in FIG. 3. The movable contact 16, then remains in the "on" position with the contact overlays 14 and 15 in conductive engagement with each other. By a small further motion of the handle 33 in the direction of the arrow 43 beyond the position in wich the toggle levers 22 and 23 are forced to snap through their metastable position, and the angled-off end 42 comes into contact with the surface 44 of the contact carrier 17 and blocks further pivoting of the actuating lever 31. However, by pressure on the handle 33, a force can be exerted on the carrier 17 by lever action about the bearing 37 at the lower end 36 of the locking lever 35. This force is sufficient in some cases to separate the contact overlays 14 and 15 that are welded together. As is shown in FIG. 3, the locking of the switch lock is obtained in this operation, i.e., the main pawl 27 is held by the lock 28.

In order to incorporate the locking lever 35, in the compact circuit breaker 1, it is merely necessary that the lower part 3 of the housing 2 have the bearing opening 37 as described hereinabove. The other parts or surfaces that cooperate with the bearing lever are available anyway in the circuit breaker mechanism. Therefore, if a circuit breaker is to be equipped with a locking lever, the lower part 36 of that lever is inserted into the bearing opening 37 where it comes to a stop adjacent the carrier 17, with the upper part 40 against the surfaces 39 of the handle 33 and with the angled-off portion 42 in the vicinity of the surface 44 of contact carrier 17.

In the embodiment described, the locking lever 35 has at its lower end a surface that is continuously rounded in a circular arc. The locking lever can also be provided with three crowned surfaces that form sections of the circular arc. This is permissible because the small angle of rotation of the locking lever 35 does not necessarily require a continuously rounded profile. The point of engagement of the angled-off part 42 at the surface 44 contact barrier 17 can be varied by different forms of the extension of the locking lever in order to exert a smaller or larger separation force on the movable contact. Similarly, the arrangement of the bearing point 37 is subject to considerations as to how large the desired separation force should be, or how the support point should be best arranged in the housing. In the embodiment shown, the support point 37 is at the lowest point of the lower part 3 of the housing 2 and is below the connecting line of the switching shaft and the stationary contact 7. The toggle lever described, as well as the locking lever, can be provided in pairs in order to equalize the engagement force. This is also true for other elements of the circuit breaker such as the springs.

What is claimed is:

1. In a circuit breaker comprising a housing, at least one stationary contact and one movable contact, a control shaft, a carrier mounted on the control shaft and connected to the movable contact to move the same relative to the fixed contact, a handle, an actuating lever connected to the handle to be controlled thereby, a pressure spring connected to the carrier and to the movable contact to exert pressure on the movable contact to force it toward the fixed contact, a drive spring connected to the actuating lever, and a toggle lever system engaging the carrier, and including a toggle joint pin, the invention comprising:

a locking lever, one end of the locking lever engaging the handle;

pivotal support means for the locking lever;

a first working surface of the locking lever;

an abutting surface on the carrier opposite the working surface and spaced therefrom by a distance less than the distance the working surface moves when the operating handle moves from its "on" position to its "off" position: and a second working surface on the locking lever opposite the toggle joint pin of the toggle lever system to engage the toggle joint pin at an intermediate position in the path of movement of the locking lever.

2. The invention according to claim 1 in which the pivotal support for the locking lever comprises a recess in the housing and is located between the control shaft and the stationary contact.

3. The invention as defined in claim 2 in which the recess is below a straight line connecting the control shaft and the stationary contact.

4. The invention according to claim 1 in which the locking lever comprises a flat sheet metal piece having circular contour portions at the bearing point and at the point of engagement with the handle, the locking lever further comprising an angled-off end with the first working surface at the end thereof to engage the carrier of the movable contact portion.

5. The invention according to claim 1 in which the locking lever comprises a region cooperating with the toggle joint pin to engage the toggle joint pin when the handle is moved toward its "off" position, the region being located relative to the toggle joint pin to engage the toggle joint pin before the angled-off part engages the abutting surface of the movable contact portion.

* * * * *